United States Patent [19]

Knott et al.

[11] 4,154,166

[45] May 15, 1979

[54] LABEL PRINTING AND APPLYING APPARATUS

[75] Inventors: Gerald J. Knott, Black Jack, Mo.; Gerald C. Laverty, Santa Clara, Calif.

[73] Assignee: Cosco Industries Incorporated, Spring Valley, N.Y.

[21] Appl. No.: 854,391

[22] Filed: Nov. 23, 1977

Related U.S. Application Data

[63] Continuation-in-part of Ser. No. 802,456, Jun. 1, 1977, abandoned.

[51] Int. Cl.[2] ..... G07B 1/06; B41K 1/38

[52] U.S. Cl. ..... 101/291; 101/382 MV; 101/379; 101/93.02

[58] Field of Search ..... 101/368, 379, 288, 291, 101/292, 109, 111, 110, 99, 382 MV, 382 R, 93.02, 407 BP, 380, 401.1

[56] References Cited

U.S. PATENT DOCUMENTS

| | | | |
|---|---|---|---|
| 1,001,689 | 8/1911 | Rogers | 101/382 MV |
| 2,625,100 | 1/1953 | Williams et al. | 101/93.02 |
| 2,792,778 | 5/1957 | Schlegel et al. | 101/292 |
| 2,871,783 | 2/1959 | Schmutz | 101/380 |
| 2,919,645 | 1/1960 | Leeds | 101/368 |
| 2,962,964 | 12/1960 | Munson | 101/380 |
| 2,994,266 | 8/1961 | Sparrow | 101/382 MV |
| 3,034,391 | 5/1962 | Pannier | 101/382 MV |
| 3,180,259 | 4/1965 | McKay | 101/382 MV |
| 3,307,479 | 3/1967 | Messmer | 101/382 R |
| 3,377,949 | 4/1968 | Prince | 101/397 |
| 3,420,172 | 1/1969 | Kaplan | 101/291 |
| 3,490,365 | 1/1970 | Roche | 101/292 |
| 3,714,894 | 2/1973 | Robinson | 101/382 MV |
| 3,782,279 | 1/1974 | Carboni et al. | 101/288 |
| 3,834,302 | 9/1974 | Canaiy | 101/288 |
| 3,857,224 | 12/1974 | Hewitt | 101/382 MV |
| 3,903,794 | 9/1975 | Grupe et al. | 101/401.1 |
| 3,951,061 | 4/1976 | Bremmer et al. | 101/288 |
| 3,957,562 | 5/1976 | Hamisch | 101/291 |
| 4,010,682 | 3/1977 | Hamisch, Jr. | 101/288 |

*Primary Examiner*—William Pieprz

*Attorney, Agent, or Firm*—Koenig, Senniger, Powers and Leavitt

[57] ABSTRACT

A hand-held label printing and applying gun for large, legible special-purpose labels. The gun has a printing head in which a printing mat is removably held in place by a magnet so as to facilitate quick change of printing mats.

9 Claims, 7 Drawing Figures

LABEL PRINTING AND APPLYING APPARATUS

CROSS REFERENCE TO A RELATED APPLICATION

This application is a continuation-in-part of application Ser. No. 802,456, filed June 1, 1977.

BACKGROUND OF THE INVENTION

This invention relates to label printing and applying apparatus and more specifically to such apparatus which is in the form of a hand-held, hand-operated gun.

In retail stores, it is a common merchandising practice to place certain labels on items to highlight special promotions or special features of a product. These special labels may inform a customer that the item is on sale, is a special item, or is of a particular grade or class. One of the more common uses of these special labels is on packages of meat in a self-service meat counter of a supermarket. Typically, these special meat package labels may carry a copy saying "FRESH," "BARBECUE," "SPECIAL," "SALE," or whatever is desired.

These special labels have been heretofore preprinted on rolls of adhesive-backed labels by commercial label printers. The rolls of preprinted labels are then sold to a store and store personnel hand-apply the labels to the desired packages without the aid of any dispensing or applying device. As a result applying these labels in this way is difficult and time consuming. Also, preprinted labels usually may be purchased only in large quantities and typically extra charges are made for printing labels with a special message or which identify a particular store.

Reference may be made to such U.S. patents as U.S. Pat. Nos. 3,420,172, 3,782,279, and 3,957,562, which disclose various price-label printing and applying guns generally similar to the apparatus of this invention. These prior labeling guns, however, had a printing head which utilized a series of endless adjustable printing bands so that the price to be printed on the blank labels could readily be changed. While these adjustable printing band-type labeling guns may be sized to print special indicia labels, their printing heads would be much too large if the printing bands were made large enough to print large indicia for the desired special labels.

Reference is also made to such U.S. patents as U.S. Pat. Nos. 2,994,266, 3,307,479, 3,714,894, and 3,857,224, which disclose various prior art printing apparatus believed relevant to the apparatus of the present invention.

SUMMARY OF THE INVENTION

Among the several objects and features of this invention may be noted the provision of a label printing and applying apparatus which readily prints and applies special labels to a variety of packages or other objects to be labeled; the provision of such apparatus which is hand-held and hand-operated; the provision of such apparatus which prints large type size indicia; the provision of such apparatus which prints labels of a quality comparable to preprinted labels; the provision of such apparatus which may be supplied with a plurality of printing mats enabling a user to print any number of labels with desired indicia thereon; the provision of such apparatus in which the printing mat may be simply changed without the use of even simple hand tools; the provision of such apparatus in which printing mats may be readily and inexpensively made up thereby enabling the user to make any desired special label; the provision of such apparatus which prints and applies a label to the package in one operation thereby speeding up application of the labels; the provision of such apparatus which prints many thousands of labels of good legible quality before its ink supply must be replenished; the provision of such apparatus in which the printing mat may be readily changed in such manner as to not soil the hands of the user; and the provision of such apparatus which is inexpensive to manufacture, which requires no special training or skill to use, and which is reliable in operation.

Briefly, a hand-held label printing and applying apparatus of this invention comprises a frame, and means for holding a supply of labels, the labels being equally spaced from one another on a tape which is rolled up in a roll with the tape extending from the roll along a path through the apparatus. Manually operable means is provided for advancing the tape along its path a predetermined interval during each cycle of the apparatus. A printing station is provided along the path at which a label is printed with preselected indicia. A dispensing station is also located along a path at which a printed label is dispensed from the apparatus for application to a package or other object to be labeled. Means operable in conjunction with the advancing means prints the indicia on the label at the printing station during each cycle of the apparatus. The printing means comprises a printing head movable between a retracted position in which it is clear of the labels and a printing position in which it prints the indicia on a label at the printing station. Means is provided for inking the printing head. The printing head is pivotally mounted on the frame for pivotal movement between its retracted and printing positions. A printing mat including raised printing type characters is carried by the printing head. The type characters are inked by the inking means so as to print the indicia on the label at the printing station during each cycle of the apparatus. Means is provided for magnetically holding the printing mat on the printing head whereby one printing mat may be readily removed from the printing head and replaced by another. Other means is provided supporting the printing mat for limited movement of the printing mat relative to the printing head so that upon the printing mat printingly engaging a label at the printing station, the printing mat is substantially free to move relative to the printing head to align itself so as to be substantially parallel to the plane of the label at the printing station.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
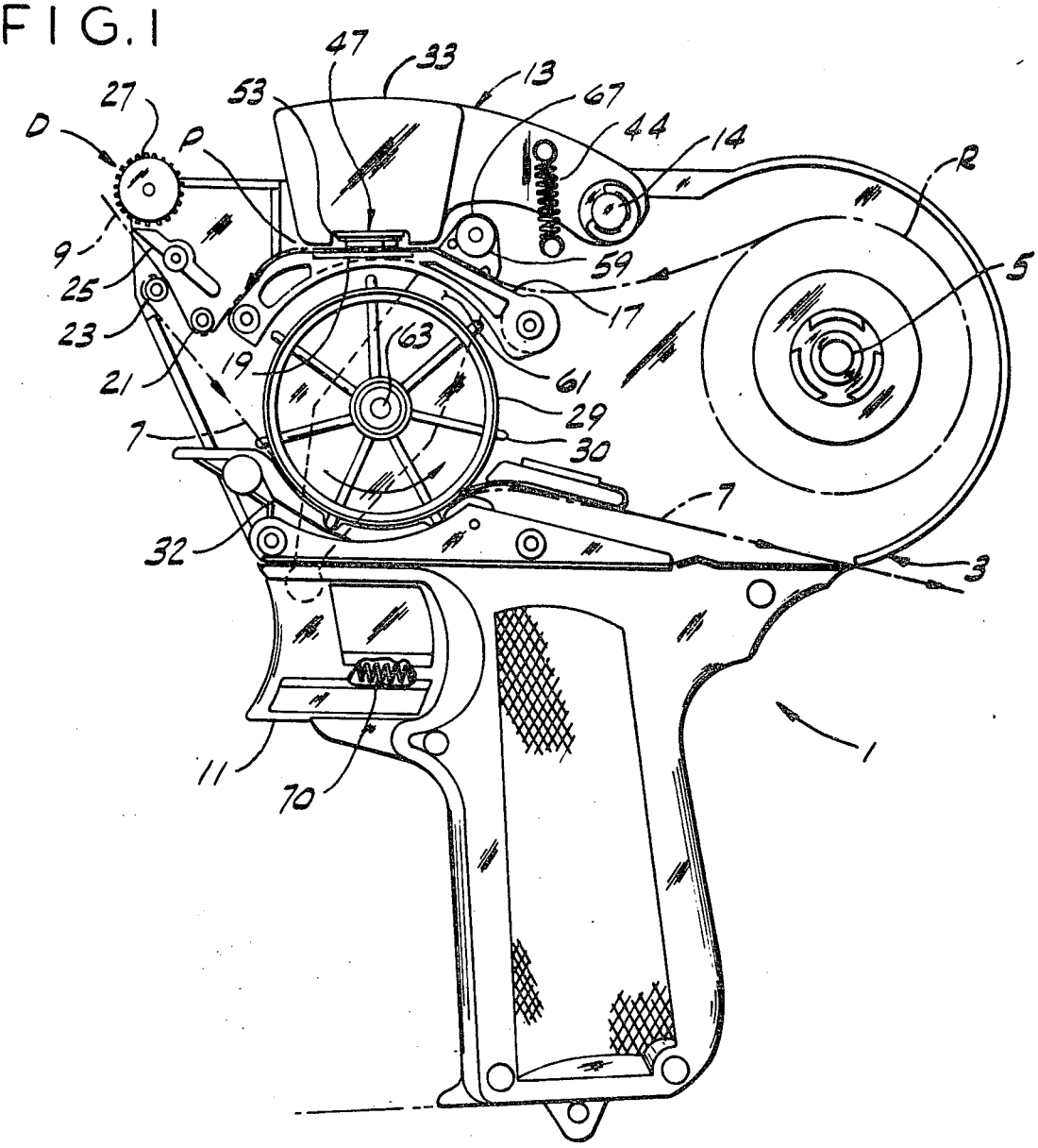
FIG. 1 is a side elevational view of a label printing and applying gun of this invention with one side cover of the gun removed to show various operating parts of the gun.
Figure 6:
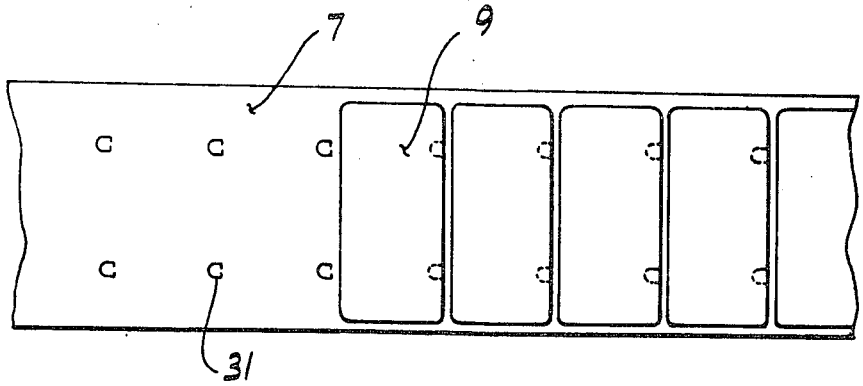
FIG. 6 is a plan view of a plurality of labels to be printed by the apparatus of this invention.

Referring now to the drawings, a hand-held and hand-operated label printing and applying apparatus (referred to as a labeling gun) is indicated in its entirety by reference character 1. The labeling gun has a main frame 3 preferably of molded synthetic resin material (e.g., plastic) or the like. A spindle, as indicated at 5, is provided for journalling a roll R of labels. The roll is constituted by a continuous backing paper tape 7 having adhesive-backed labels 9 adhered thereto at equal intervals therealong (see FIG. 6). Labels 9 are preferably of paper or other suitable material which may be readily printed. As shown in FIG. 1, tape 7 with labels 9 is unrolled from roll R to extend through the gun along a path, as indicated by the arrows in FIG. 1. A printing station P is provided on the path of the labels at which a label is printed with selected indicia. Also, a dispensing station D is provided along the path at which printed labels 9 are peeled from backing tape 7 and are dispensed for being applied (i.e., adhered) to the package or other item to be labeled.

Labeling gun 1 further includes a manually operable trigger 11 which, via a mechanism such as shown in coassigned U.S. Pat. No. 3,782,279, advances the labels along their path a predetermined distance or interval to move a printed label from printing station P and to move the next label to be printed to the printing station and to dispense a printed label at dispensing station D. While certain details of the label-advancing system will be herein explained in detail, reference should be made to the above-mentioned coassigned patent for more specific details of the label-advancing or indexing means.

Figure 2:
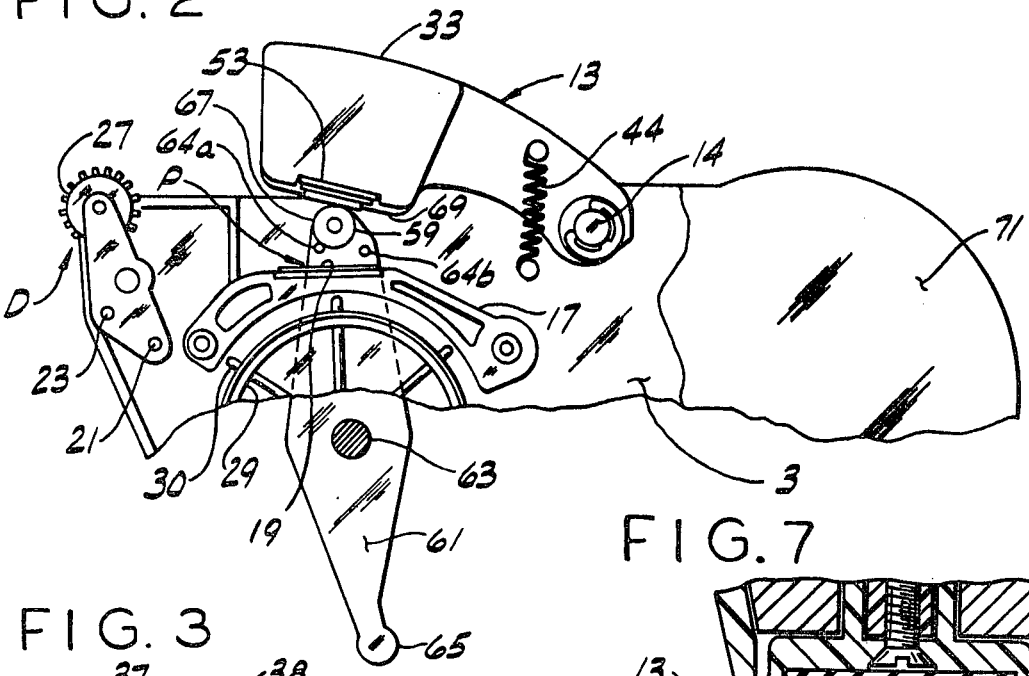
FIG. 2 is a view of the upper portion of the gun, as shown in FIG. 1, illustrating the printing head of the gun in its raised retracted position above the printing station with the printing mat carried by the printing head being inked by an ink roller movable over the printing mat.

As generally indicated at 13, a printing head is pivotally connected to a body 3, as indicated at 14, for pivotal movement in a generally vertical direction when the labeling gun is in its normal operating or level position (as shown in FIG. 1) between a printing position (see FIG. 1) in which a label at printing station P is printed and a raised retracted position (as shown in FIG. 2) in which the printing head is clear of a label at the printing station. As shown in FIG. 1, tape 7 with labels 9 on its upper or outer face is unrolled from the top of roll R to extend over an anvil member 17 fixed to frame 3. The anvil has a metal bed plate 19 which provides a flat, hard surface or bed on which a label at printing station P may be printed. The tape with the now-printed labels thereon extends from the printing station under a roller 21 and over a label separator roller 23. Tape 7 breaks sharply over the label separator roller and extends downwardly therefrom. It will be appreciated that as the tape passes over the label separator roller, the labels separate from the backing tape and pass beneath a presser plate 25 and presser roller 27 with the adhesive side of the label facing a package to be labeled. Thus, by wiping the presser roller on the package, the printed and dispensed label may be readily adhered to the package.

Tape 7 extends partially around a drive wheel 29 having lugs 30 thereon, the latter engaging uniformly spaced perforations or holes 31 (see FIG. 6) in backing tape 7 so that positive registration of the label tape relative to the drive wheel is provided. A presser member 32 resiliently holds tape 7 on drive wheel 29 thereby to insure that the tape is advanced upon actuation of the drive wheel. Drive wheel 29 is driven through a predetermined fraction of a revolution on each cycle of the apparatus (i.e., each time trigger 11 is actuated) by a one-way ratchet drive mechanism, such as is shown in the above-noted U.S. Pat. No. 3,782,279, upon initial actuation of trigger 11 so as to advance the label tape a predetermined distance thereby to move a previously printed label from printing station P and to advance the next label to be printed to the printing station. Lugs 30 positively engage holes 31 in tape 7 and prevent slipping between the drive wheel on the tape thereby to insure that the tape is accurately advanced the desired distance on each cycle of the labeling gun. Upon return of trigger 11 to its initial position, drive wheel 29 does not rotate.

Figure 7:
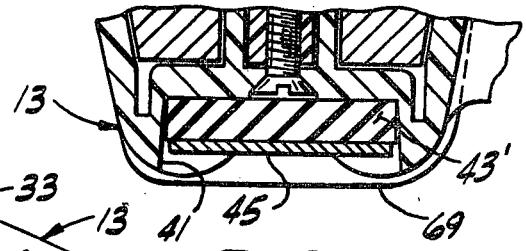
FIG. 7 is a view of a portion of FIG. 3 illustrating a solid elastomeric support for the printing mat.
Figure 4:
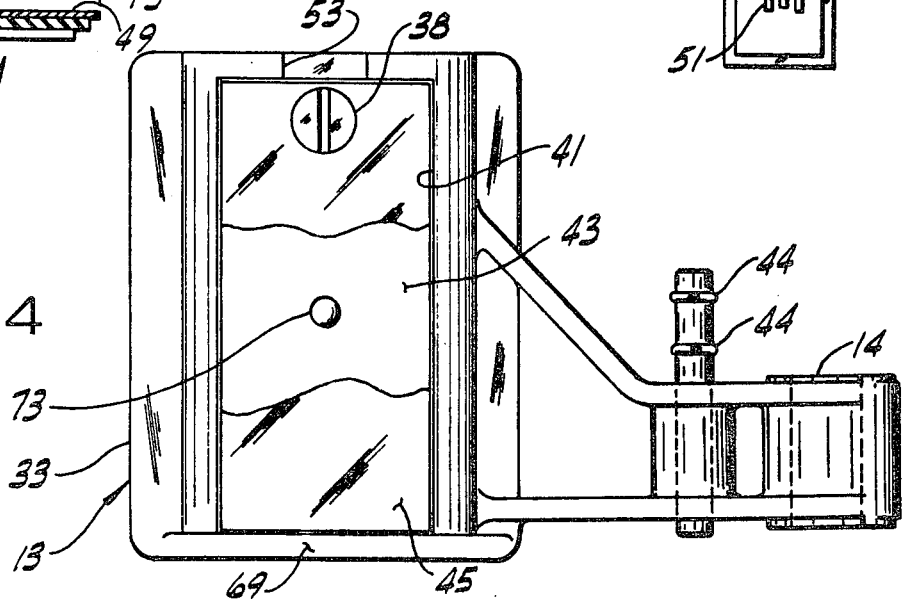
FIG. 4 is a bottom view of the printing head showing a recess in the printing head for receiving the printing mat.

Printing head 13 has a body 33 preferably of molded synthetic resin (plastic) material. As shown in FIG. 4, the printing-head body has a chamber 34 therein enclosed by removable cover 37. The cover is secured in place by screws 38. Weights 39 of suitable metal are secured in position within chamber 35 for purposes as will appear. A recess 41 is provided in the face of body 33 toward anvil 17 when the printing head is in its printing position. A cushion 43 of compressible, resilient elastomeric material (e.g., sponge neoprene) approximately $\frac{1}{8}$ inch (0.3 cm.) thick is bonded in recess 41 by a suitable adhesive. As shown in FIG. 7 and as indicated at 43', the elastomeric pad may be of solid, cured natural or synthetic rubber having as low a durometer reading as possible, preferably less than 30 Shore A and even more preferably less than about 20 Shore A. Such a solid rubber pad avoids or minimizes any tendency for it to take a compression set which can occur with certain foam rubbers. Other foam materials which do not take a set or molded elastomeric parts having compression pockets or voids and solid rubber compression supports molded therein may also be used to resiliently support the printing mat in the manner hereinafter specified and to effectively resist taking a compression set. A flat plate magnet 45 is adhered to the outer face of cushion 43 or 43'. A pair of tension springs 44 is interposed between body 33 and frame 3 for resiliently biasing the printing head downwardly toward anvil plate 19 and toward its printing position.

A printing mat, as generally indicated at 47, is provided to fit in recess 41 and to be removably secured to printing head 13 by magnet 45. The printing mat has a base or backing plate 49 of suitable magnetizing material (e.g., a steel plate or the like). Raised printing type characters or indicia 51 are bonded to the outer face of the base plate by a suitable adhesive. Preferably, these raised type characters are raised above the surface of base plate 49 and are of a flexible, resilient material (e.g., cured natural rubber) having a durometer hardness ranging between about 20–50 Shore, and more preferably ranging between about 30–35 Shore. The printing mat may, for example, be about $1\frac{1}{2} \times \frac{5}{8}$ in. (3.8 × 1.6 cm.) and type characters 51 may be about 0.07 in. (0.18 cm.) thick. The flexible type characters may be molded in any conventional manner; for example, they may be fabricated in the same manner as flexographic printing plates and then cut to the proper size.

Figure 5:
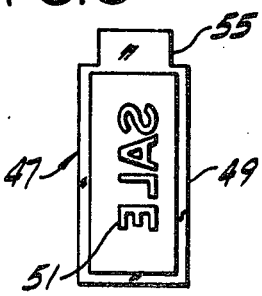
FIG. 5 is a view of the printing side of the printing mat illustrating a base plate of the printing mat with raised flexible type or printing indicia bonded thereto.

Printing body 33 has a notch 53 in one wall of recess 41. Base plate 49 has a finger tab 55 (see FIG. 5) extending endwise therefrom. With printing mat 47 received in recess 41 of printing head 13, finger tab 55 extends through notch 53 out beyond the side of the printing head so as to enable one to readily manually grip the printing mat in such manner that one printing mat may be readily removed from the printing head merely by pulling it from magnet 45 and by replacing it with another. In addition to providing a handy manner of gripping the printing mat, the finger tab allows one to change the printing mat without contacting the ink on the printing surfaces of the printing mat thus preventing the user from soiling his fingers. Of course, the use of the magnet to secure the printing mat in place on the printing head allows the printing mat to be rapidly changed without using even simple hand tools or undoing any fasteners.

Printing mat 47, when installed in printing head 13, is inked by means of an ink roller 59 which carries a supply of ink in a sponge roller. These ink rollers are conventional and are well known to those skilled in the label-printing field. This ink roller contains a sufficient supply of ink to print thousands of labels. Upon the ink supply in the ink roller becoming depleted, the old ink roller may be readily removed from the labeling gun and replaced with a fresh one. Ink roller 59 is cantilevered from a rocker member 61 journalled on frame 3 by a pivot shaft 63, the latter also serving as the axle for drive wheel 29. A pair of rods 64*a*, 64*b* below and on opposite sides of the ink roller prevent labels 9 from inadvertently touching the ink roller. Rocker member 61 has a ball 65 on its lower end which is socketed in trigger 11. The upper edge of rocker member 61 constitutes a cam surface 67 which cammingly engages a cam follower surface 69 on printing-head body 33. Thus, upon actuation of trigger 11, ball 65 is engaged by the trigger and causes rocker member 61 to rotate in counterclockwise direction (as viewed in FIGS. 1 and 2) about pivot shaft 63. Cam surface 67 thus engages follower surface 69 on the printing head thereby raising the printing head from its lowered printing position (as shown in FIG. 1) to its raised retracted position (as shown in FIG. 2). As the rocker member continues to rotate in counterclockwise direction, ink roller 59 moves between printing head 13 and anvil plate 19 and rolls over the printing surfaces of type characters 51 on printing mat 47 thereby to initially ink the printing mat. Continued actuation of trigger 11 also actuates the one-way drive for drive wheel 29 so as to advance the labels along their path to bring the next label into position over anvil plate 19. Upon releasing trigger 11, a return spring 70 (see FIG. 1) in the trigger returns rocker member 61 toward its original position (as shown in FIG. 1) thereby to move ink roller 59 back over the printing mat. As cam surface 67 moves clear of cam follower surface 69 on the printing head, the printing head is abruptly released from its raised retracted position. The printing head is then actuated downwardly under the bias of weights 39 and springs 44 toward anvil plate 19. The resilient type characters 51 of the printing mat are thus forcibly driven down on label 9 to force it down onto the rigid anvil plate 19 thereto to clearly imprint the indicia of the printing mat on the label. It will be understood that snce printing mat 47 of this invention has a large printing area, as compared to prior adjustable labeling band-type price-label printing guns, significantly more force must be applied to printing head 13 so as to print well-defined, legible labels. In accordance with this invention, the downwardly accelerating printing head moving toward anvil plate 19 under the influence of weights 39 and springs 44 impacts type characters 51 against the label on the anvil plate and the momentum of the moving printing head instantaneously applies appreciably more force on the printing surfaces of type characters 51 than can be exerted by springs 44 alone. By supporting printing mat 47 on printing head 13 by compressible foam cushion 43 or on solid rubber cushion 43', the printing mat is gimballed on the printing head so as to be self-aligning with respect to the plane of anvil plate 19 when the type characters printingly engage a label on the anvil plate thereby to insure that the entire printing area of the printing mat uniformly contacts and prints on label 9.

It will be understood that the upper portion of frame 3 is adapted to have readily removable side cover 71 (see FIG. 2) secured thereto for covering the various components of the gun and for holding roll R of labels on spindle 5.

Figure 3:
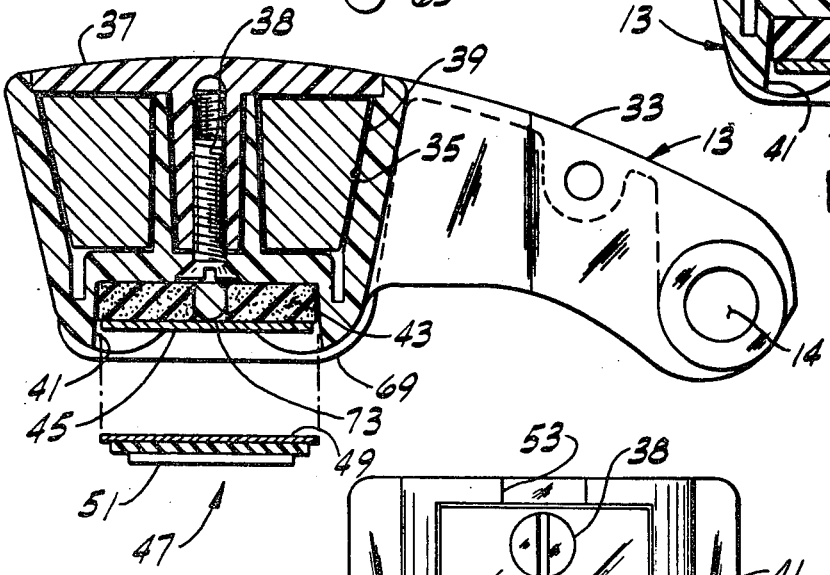
FIG. 3 is an enlarged exploded cross-sectional view of the printing head and the printing mat illustrating a foam rubber support for the printing mat.

As shown in FIGS. 3 and 4, an optional fixed gimbal point or pivot member 73 having a rounded outer end extends from the base of recess 41. This gimbal point is surrounded by cushion 43 and its outer end contacts the center of magnet 45. Thus, upon printing mat 57 printingly engaging a label on bed plate 19, the printing mat and the magnet are substantially free to rock in any direction on the end of the gimbal point and to compress cushion 43 thus allowing the printing mat to align itself with the plane of the bed plate and the label thereon as heretofore described. The fixed gimbal point, however, holds the center of the magnet a desired distance from the base of recess 41 and thus helps extend the cushion to its original position to reduce a tendency for the cushion to develop a permanent set. In other instances, the use of solid rubber in cushion 43' may be preferred because the solid better resists taking on a compression set.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

What is claimed is:

1. In a hand-held label printing and applying apparatus comprising a frame, means for holding a supply of labels rolled up in a roll and extending from said roll along a path through said apparatus, manually operable means for advancing said labels along said path a predetermined interval during each cycle of the apparatus, a printing station along said path at which a label is printed with preselected indicia, a dispensing station at which a printed label is dispensed from the apparatus for application to a package or other object to be labeled, means operable in conjunction with said advancing means for printing said indicia on a label at said printing station during each cycle of said apparatus, said printing means comprising a printing head movable between a retracted position in which it is clear of said labels and a printing position in which it prints said indicia on a label at said printing station, and means for inking said printing head, wherein the improvement comprises: said printing head having a body pivotally mounted on said frame for pivotal movement between its stated retracted and printing positions, a printing mat including raised printed type characters each of said characters having a printing surface adapted to be inked by said inking means and to print said indicia on said label at said printing station during each cycle of the apparatus, said printing mat having a substantially rigid backing generally the size of said printing mat carrying said printing characters so that said printing surfaces of said characters are maintained in a plane, said backing being of a magnetizable material, said printing head further having a cushion of resilient, compressible material affixed thereto and a flat, plate-like magnet secured to the outer face of said cushion for face-to-face magnetic engagement with said backing thereby to magnetically hold said printing mat on said printing head whereby one printing mat may be readily removed from said printing head and replaced by another, said cushion supporting said magnet and said printing mat for limited movement relative to the printing head so that upon said printing mat printing engaging a label at said printing station, said printing mat is substantially free to move relative to said printing head so as to align the plane of the printing surfaces of said type characters with the label at said printing station thereby to uniformly print on said label.

2. In apparatus as set forth in claim 1 wherein said printing head has a recess therein for reception of said printing mat.

3. In apparatus as set forth in claim 2 wherein one wall of said printing head defining said recess has a notch therein between said recess and the exterior of said printing head, said backing having a finger tab extending therefrom and being adapted to fit in said notch so as to extend out beyond said printing head thereby to enable one to readily grip the printing mat for quick change of the printing mat.

4. In apparatus as set forth in claim 1 wherein said printing type characters are of an elastomeric material having a durometer hardness ranging between about 20–50 Shore.

5. In apparatus as set forth in claim 1 wherein said printing head is pivotally secured to said frame for pivotal movement between its raised retracted and printing positions in generally vertical direction when the apparatus is in its normal operating position, said apparatus further comprising spring means for biasing said printing head down toward its printing position, a weight fixed in said printing head for gravity-biasing the latter toward its printing position, and means operable in conjunction with said advancing means for holding said printing head in its raised retracted position against the bias of said spring means and said weight and for releasing said printing head for movement toward its printing position so that the momentum of the printing head moving toward its printing position at least momentarily presses said printing type characters against said label with sufficient force to legibly print said indicia on said label.

6. In apparatus as set forth in claim 1 wherein said printing head includes a fixed gimbal member secured to said printing head and extending outwardly from the base of said recess for engagement by said magnet, said gimbal member being surrounded by said cushion whereby upon said printing mat printingly engaging said label at said printing station said magnet is substantially free to rock in any direction on said gimbal member.

7. In apparatus as set forth in claim 1 wherein said cushion is of elastomeric foam material.

8. In apparatus as set forth in claim 1 wherein said cushion is of solid elastomeric material.

9. A hand-held label printing and applying gun comprising a frame, means for holding a roll of labels, said labels extending from said roll along a path through the gun, a printing station along the path at which a label is printed with selected indicia, a dispensing station along the path at which a printed label is dispensed from the gun for application to a package or other object to be labeled, a trigger, means actuable by said trigger for advancing said labels along said path a predetermined interval on each cycle of the apparatus to bring the next label to be printed into position at said printing station and for dispensing a printed label from the gun at said dispensing station during each operating cycle of the gun, a printing head movable in response to actuation of said trigger for printing a label at said printing station during each cycle, said printing head having a compressible resilient cushion, a substantially flat, plate-like magnet secured to the outer face of said cushion, and a printing mat having raised type characters for printing said indicia on labels and a substantially rigid, plate-like backing member of magnetizable material carrying said type characters engageable with said magnet for face-to-face magnetic securement of said printing mat to said magnet, said backing member being substantially the size of said printing mat and holding the printing surfaces of said printing characters in a plane, said apparatus further comprising means operable in response to actuation of said trigger for inking said printing type characters during each cycle of the gun, an anvil at said printing station for supporting a label which is to be printed at said printing station, said printing head being pivotally movable between a raised retracted positon clear of the label at said printing station and a printing position at which said printing type characters press said label at said printing station between said printing type characters and said anvil, said cushion being compressible when said printing type characters bear against said label and said anvil thereby to permit said printing mat to shift relative to the printing head and to permit the plane of the outer faces of said printing type characters to align itself with the plane of said anvil and the plane of said label so as to insure uniform printing of said indicia on said label, said printing head including a weight fixed thereon for gravity-biasing it toward said printing position and spring means for resiliently biasing it toward its printing positon, said printing head moving abruptly from its retracted to its printing position under the influence of said weight and said spring means so that said printing type characters are impacted against said label to be printed at said printing station.

* * * * *